US012312061B2

(12) United States Patent
Morvillo

(10) Patent No.: US 12,312,061 B2
(45) Date of Patent: May 27, 2025

(54) INTEGRATED ENGINE AND RUDDER CONTROL

(71) Applicant: Robert A. Morvillo, Dover, MA (US)

(72) Inventor: Robert A. Morvillo, Dover, MA (US)

(73) Assignee: Vector Controls Inc., Newton, MA (US)

( * ) Notice: Subject to any disclaimer, the term of this patent is extended or adjusted under 35 U.S.C. 154(b) by 516 days.

(21) Appl. No.: 17/363,060

(22) Filed: Jun. 30, 2021

(65) Prior Publication Data

US 2022/0135196 A1 May 5, 2022

Related U.S. Application Data

(63) Continuation of application No. PCT/US2020/012101, filed on Jan. 2, 2020.

(60) Provisional application No. 62/787,752, filed on Jan. 2, 2019.

(51) Int. Cl.
*B63H 25/42* (2006.01)
*B63H 25/38* (2006.01)

(52) U.S. Cl.
CPC ..... *B63H 25/42* (2013.01); *B63H 25/38* (2013.01)

(58) Field of Classification Search
CPC ..... B63H 25/42; B63H 25/38
See application file for complete search history.

(56) References Cited

U.S. PATENT DOCUMENTS

| | | | |
|---|---|---|---|
| 6,941,195 | B2 | 9/2005 | Hamamatsu et al. |
| 2008/0004759 | A1 | 1/2008 | Cultrara et al. |
| 2011/0172858 | A1 | 7/2011 | Gustin et al. |
| 2017/0351259 | A1 | 12/2017 | Tamura et al. |

FOREIGN PATENT DOCUMENTS

| | | | |
|---|---|---|---|
| WO | WO 2017/202458 | A1 | 11/2017 |
| WO | WO-2018008589 | A1 * | 1/2018 |

OTHER PUBLICATIONS

Translation of WO 2018008589-A1, Jan. 2018, Murata. (Year: 2018).*
International Search Report and Written Opinion for International Application No. PCT/US2020/012101 mailed Jan. 2, 2020.
International Preliminary Report on Patentability for International Application No. PCT/US2020/012101 mailed Jul. 15, 2021.
PCT/US2020/012101, Jan. 2, 2020, International Search Report and Written Opinion.
PCT/US2020/012101, Jul. 15, 2021, International Preliminary Report on Patentability.
Extended European Search Report dated Oct. 4, 2022 in connection with European Application No. 20736119.7.

* cited by examiner

*Primary Examiner* — Stephen P Avila
(74) *Attorney, Agent, or Firm* — Wolf, Greenfield & Sacks, P.C.

(57) ABSTRACT

Some embodiments relate to a control system for a marine vessel having a first propulsion system and a second propulsion system, the control system comprising: a processor configured to: receive a steering command and a thrust command; and control at least the first propulsion system and the second propulsion system based on the steering command and the thrust command.

9 Claims, 10 Drawing Sheets

PROPELLER

RUDDER

RUDDER DEFLECTED 20°

STEERING WITH RUDDERS ONLY

STEERING BY USING LEVERS TO APPLY DIFFERENTIAL PROPELLER RPM

RUDDERS AND DIFFERENTIAL RPM
INTEGRATED INTO THE STEERING WHEEL ( OR TILLER)
COMMAND
LEVERS AT SAME POSITIONS

RUDDERS AND DIFFERENTIAL RPM INTEGRATED INTO THE STEERING WHEEL (OR TILLER) COMMAND, USING A JOYSTICK IN PLACE OF PORT-STBD CONTROL LEVERS

RUDDERS AND DIFFERENTIAL RPM INTEGRATED INTO THE TILLER (OR STEERING WHEEL) COMMAND, USING A JOYSTICK , INCLUDING TRANSVERSE THRUST MANEUVERS

INTEGRATED ENGINE AND RUDDER CONTROL

RELATED APPLICATIONS

This application is a continuation of International Patent Application No. PCT/US2020/012101, entitled "INTEGRATED ENGINE AND RUDDER CONTROL," filed Jan. 2, 2020, which claims the benefit of U.S. Provisional Patent Application No. 62/787,752, entitled "INTEGRATED ENGINE AND RUDDER CONTROL," filed Jan. 2, 2019, each of which is herein incorporated by reference in its entirety.

TECHNICAL FIELD

The present disclosure relates to marine vessel propulsion and control systems.

BACKGROUND

Various forms of propulsion have been used to propel marine vessels over or through the water. One type of propulsion system comprises a prime mover, such as an engine or a turbine, which converts energy into a rotation that is transferred to one or more propellers having blades in contact with the surrounding water. The rotational energy in a propeller is transferred by contoured surfaces of the propeller blades into a force or "thrust" which propels the marine vessel. As the propeller blades push water in one direction, thrust and vessel motion are generated in the opposite direction. Many shapes and geometries for propeller-type propulsion systems are known.

SUMMARY

Some embodiments relate to a control system for a marine vessel having a first propulsion system and a second propulsion system, the control system comprising: a processor configured to: receive a steering command and a thrust command; and control at least the first propulsion system and the second propulsion system based on the steering command and the thrust command.

The processor may be configured to control at least the first propulsion system and the second propulsion system based on the steering command and the thrust command by controlling thrusts of the first and second propulsion systems differentially.

The processor may be configured to control the first propulsion system to produce an ahead thrust and control the second propulsion system to produce a reverse thrust in response to the steering command.

Some embodiments relate to a control system for a marine vessel having a first propulsion system and a second propulsion system, the control system comprising: a processor configured to: receive a steering command; and control at least the first propulsion system and/or the second propulsion system based on the steering command.

Some embodiments relate to a control system for a marine vessel having a first propulsion system, a second propulsion system, and a first rudder, the control system comprising: a processor configured to: receive a steering command; and control at least the first propulsion system, the second propulsion system and the first rudder based on the steering command.

Some embodiments relate to a control system for a marine vessel having a first propulsion system, a second propulsion system, a first rudder, and a second rudder, the control system comprising: a processor configured to: receive a steering command and/or a thrust command; and control at least the first propulsion system, the second propulsion system, the first rudder and the second rudder based on both the steering command and the thrust command.

The first rudder may be behind the first propulsion system, and wherein the processor is configured to control the first rudder to have a deflection angle of zero when the first propulsion system produces thrust astern.

Some embodiments relate to method of controlling a marine vessel having a first propulsion system, a second propulsion system, a first rudder, and a second rudder, the method comprising: operating a processor to receive a steering command and/or a thrust command; and controlling at least the first propulsion system, the second propulsion system, the first rudder and the second rudder based on both the steering command and the thrust command.

Some embodiments relate to control system for a marine vessel having a first propulsion system, a second propulsion system, a first rudder corresponding to the first propulsion system, and a second rudder corresponding to the second propulsion system, the control system comprising: a processor configured to: control the first and second rudders to be positioned at different deflection angles.

The first rudder may be controlled to be positioned at a deflection angle of zero when the first propulsion system produces thrust astern.

Some embodiments relate to a method of controlling a marine vessel having a first propulsion system, a second propulsion system, a first rudder corresponding to the first propulsion system, and a second rudder corresponding to the second propulsion system, the method comprising: controlling the first and second rudders to be positioned at different deflection angles.

Some embodiments relate to a marine vessel comprising the control system.

Some embodiments relate to a control system for a marine vessel having a first propulsion system and a second propulsion system, the control system comprising: a processor configured to: receive a steering command and a thrust command; and control at least the first propulsion system and the second propulsion system based on the steering command and the thrust command.

The processor may be configured to control at least the first propulsion system and the second propulsion system based on the steering command and the thrust command by controlling thrusts of the first and second propulsion systems differentially.

The processor may be configured to control the first propulsion system to produce an ahead thrust and control the second propulsion system to produce a reverse thrust.

The processor may be configured to determine a control mode of the control system based on information indicating a state of forward or reverse movement of the marine vessel.

The information indicating the state of forward or reverse movement of the marine vessel may comprise the thrust command or information from a sensor.

The processor may be configured to determine the control mode by comparing the information indicating a state of forward or reverse movement of the marine vessel to a threshold.

When the information indicates forward movement of the marine vessel below a threshold or neutral forward/reverse movement of the marine vessel, the processor may set the control mode to steer the marine vessel using both the first and second propulsion systems and a first rudder.

The processor may control the first propulsion system to have a forward thrust, the second propulsion system to have a reverse thrust, and deflect the first rudder behind the first propulsion system to turn the marine vessel in the direction of the steering command.

The processor may control a second rudder behind the second propulsion system to have a deflection angle of approximately zero.

When the information indicates reverse movement of the marine vessel of a sufficient magnitude, the processor may set the control mode to steer using the first and second propulsion systems and not to steer using a rudder.

The processor may set a first rudder behind the first propulsion system and a second rudder behind the second propulsion system to each have a deflection angle of approximately zero.

When the information indicates forward movement of the marine vessel above a threshold, the processor may set the control mode to steer the marine vessel using at least one rudder and not to steer the marine vessel using the first and second propulsion systems.

Some embodiments relate to a control system for a marine vessel having a first propulsion system, a second propulsion system, and a first rudder, the control system comprising: a processor configured to: receive a steering command; and control at least the first propulsion system, the second propulsion system and the first rudder based on the steering command.

The processor may control the first propulsion system to have a forward thrust, the second propulsion system to have a reverse thrust, and deflect the first rudder behind the first propulsion system to turn the marine vessel in the direction of the steering command.

The processor may control a second rudder behind the second propulsion system to have a deflection angle of approximately zero.

Some embodiments relate to a control system for a marine vessel having a first propulsion system, a second propulsion system, a first rudder, and a second rudder, the control system comprising: a processor configured to: receive a steering command and a thrust command; and control at least the first propulsion system, the second propulsion system, the first rudder and the second rudder based on both the steering command and the thrust command.

The processor may control the first propulsion system to have a forward thrust, the second propulsion system to have a reverse thrust, and deflect the first rudder behind the first propulsion system to turn the marine vessel in the direction of the steering command.

The processor may control the second rudder behind the second propulsion system to have a deflection angle of approximately zero.

Some embodiments relate to a control system for a marine vessel having a first propulsion system, a second propulsion system, a first rudder corresponding to the first propulsion system, and a second rudder corresponding to the second propulsion system, the control system comprising: a processor configured to: control the first and second rudders to be positioned at different deflection angles.

The processor may control the first propulsion system to have a forward thrust, the second propulsion system to have a reverse thrust, and deflect the first rudder behind the first propulsion system to turn the marine vessel in the direction of the steering command.

The processor may control a second rudder behind the second propulsion system to have a deflection angle of approximately zero.

Some embodiments relate to a control system for a marine vessel having a first propulsion system, a first rudder corresponding to the first propulsion system, a second propulsion system, and a second rudder corresponding to the second propulsion system, the control system comprising: a processor configured to: receive information indicating a state of forward or reverse movement of the marine vessel; set a control mode based on the information indicating a state of forward or reverse movement of the marine vessel; based on the control mode, map a thrust command for the marine vessel and a steering command for the marine vessel into control commands for the first propulsion system, the first rudder, the second propulsion system and the second rudder; and control the first propulsion system, the first rudder, the second propulsion system and the second rudder using the control commands.

When the information indicates forward movement of the marine vessel above a threshold, the processor may set the control mode to steer the marine vessel using the first and second rudders and not to steer the marine vessel using the first and second propulsion systems.

When the information indicates forward movement of the marine vessel below a threshold or neutral forward/reverse movement of the marine vessel, the processor may set the control mode to steer the marine vessel using both the first and second propulsion systems and the first rudder.

The processor may control the first propulsion system to have a forward thrust, the second propulsion system to have a reverse thrust, and deflect the first rudder behind the first propulsion system to turn the marine vessel in the direction of the steering command.

The processor may control a second rudder behind the second propulsion system to have a deflection angle of approximately zero.

When the information indicates reverse movement of the marine vessel of a sufficient magnitude, the processor may set the control mode to steer the marine vessel using the first and second propulsion systems and not to steer the marine vessel using the first rudder or the second rudder.

Some embodiments relate to a method of controlling a marine vessel having a first propulsion system and a second propulsion system, the method comprising: receiving, by a processor, a steering command and a thrust command; and controlling, by the processor, at least the first propulsion system and the second propulsion system based on the steering command and the thrust command.

Some embodiments relate to a method of controlling a marine vessel having a first propulsion system, a second propulsion system, and a first rudder, the method comprising: receiving, by a processor, a steering command; and controlling, by the processor, at least the first propulsion system, the second propulsion system and the first rudder based on the steering command.

Some embodiments relate to a method of controlling a marine vessel having a first propulsion system, a second propulsion system, a first rudder, and a second rudder, the method comprising: receiving, by a processor, a steering command and a thrust command; and controlling, by the processor, at least the first propulsion system, the second propulsion system, the first rudder and the second rudder based on both the steering command and the thrust command.

Some embodiments relate to method of controlling a marine vessel having a first propulsion system, a second propulsion system, a first rudder corresponding to the first propulsion system, and a second rudder corresponding to the second propulsion system, the method comprising: controlling the first and second rudders to be positioned at different deflection angles.

Some embodiments relate to a method of controlling a marine vessel having a first propulsion system, a first rudder corresponding to the first propulsion system, a second propulsion system, and a second rudder corresponding to the second propulsion system, the method comprising, by a processor: receiving information indicating a state of forward or reverse movement of the marine vessel; setting a control mode based on the information indicating a state of forward or reverse movement of the marine vessel; based on the control mode, mapping a thrust command for the marine vessel and a steering command for the marine vessel into control commands for the first propulsion system, the first rudder, the second propulsion system and the second rudder; and controlling the first propulsion system, the first rudder, the second propulsion system and the second rudder using the control commands.

Some embodiments relate to a control system for a marine vessel having a first propulsion system and a second propulsion system, the control system comprising: a processor configured to: receive a steering command; and control at least the first propulsion system and/or the second propulsion system based on the steering command.

The processor may be further configured to control at least one rudder based on the steering command.

The processor may be configured to control the first and second propulsion systems to produce a differential thrust based on the steering command.

The steering command may be received from an input device, an autopilot, a dynamic positioning system or a steering control system.

The input device may comprise a helm, a wheel, a tiller or a communication interface.

The processor may be further configured to receive a thrust command and control the first and second propulsion systems based on the thrust command.

The thrust command may be an ahead or reverse thrust command.

The thrust command may be a transverse thrust command.

Some embodiments relate to control system for a marine vessel having at least one rudder, the control system comprising: a processor configured to: receive information indicating a state of forward or reverse movement of the marine vessel; and control the at least one rudder based on the information.

The information indicating the state of forward or reverse movement of the marine vessel may comprise a thrust command or information from a sensor.

The information may be received from an input device, an autopilot, a dynamic positioning system or a propulsion control system.

The thrust command may be a thrust command for the marine vessel or an individual propulsion system.

The thrust command may be an ahead or reverse thrust command.

The thrust command may be a transverse thrust command.

Some embodiments relate to a control system for a marine vessel having a first propulsion system and a second propulsion system, the control system comprising: a processor configured to: control the first and second propulsion systems to produce differential thrust in response to a steering command.

The processor may be configured to control the first and second propulsion systems to have differential RPMs in response to the steering command.

The processor may be configured to control the first and second propulsion systems to produce differential thrust in response to a steering command when the marine vessel is moving in reverse or the first and second propulsion systems are producing a net reverse thrust component.

The processor may be configured to control the first and second propulsion systems to produce differential thrust in response to a steering command when the marine vessel is stationary, producing no net thrust in an ahead direction, moving at an ahead speed below a threshold, or producing a net thrust in the ahead direction below a threshold.

The processor may be configured to steer by deflecting only a rudder behind a propulsion system producing ahead thrust.

The processor may be configured to steer the vessel using the first and second propulsion systems and not using a rudder.

The processor may be configured to steer the vessel using at least one rudder and not the first or second propulsion systems when the vessel is moving at an ahead speed above a threshold or ahead thrust is commanded above a threshold.

The processor may be configured to receive a signal from a sensor and control the marine vessel based on the signal form the sensor.

The processor may be configured to receive a thrust command and control the first and second propulsion systems based on the thrust command.

The thrust command may be received from a joystick.

The thrust command may be received from a plurality of levers.

Some embodiments relate to a control system for a marine vessel having a propulsion system and a corresponding rudder behind the propulsion system, the control system comprising: a processor configured to maintain the rudder at or approximately at a deflection angle of zero when the propulsion system is producing reverse thrust.

The processor may be configured to steer the marine vessel using the rudder when the propulsion system is producing sufficient ahead thrust.

The propulsion system may be a first propulsion system and the processor may be configured to control first propulsion system and a second propulsion system to produce differential thrusts in response to a steering command.

The foregoing summary is provided by way of illustration and is not intended to be limiting.

DETAILED DESCRIPTION

Figure 1:
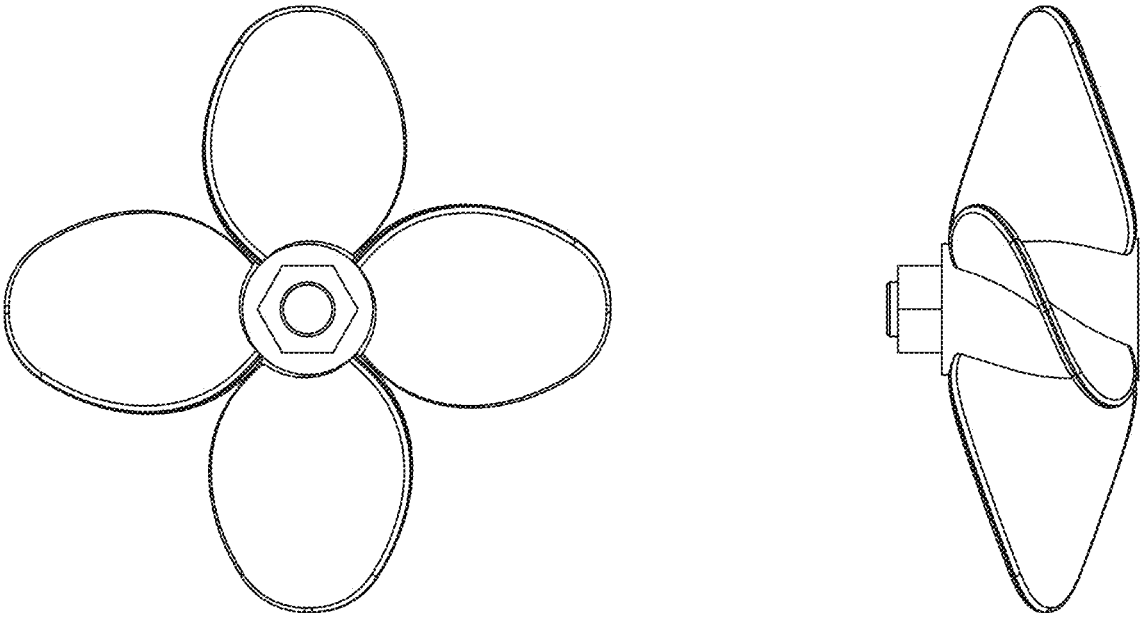
FIG. 1 shows an example of a propeller, according to some embodiments.

Various forms of propulsion have been used to propel marine vessels over or through the water. One conventional means for propelling and controlling marine vessels while transiting and maneuvering through the water comprises two propellers (sometimes referred to as twin screw) driven by two engines (sometimes referred to as prime movers). However, the apparatus and techniques described herein are not limited to two propellers driven by two engines, as they may be applied to vessels having more than two propellers and/or engines. Each propeller may be mechanically coupled to a respective engine by a reduction gear or transmission capable of clutching/declutching and reversing the propeller direction (sometimes referred to as a reversing gear). A front view and side view of one example of a propeller is shown in FIG. 1. However, the apparatus and techniques described herein are not limited to use of a propeller as illustrated in FIG. 1, as any suitable style or design of propeller may be used in propeller-driven craft. Further, the techniques described herein are not limited to propulsion by propellers, as numerous other types of propulsion systems are known in the art. In some embodiments, the propellers are not steerable: that is, the propellers may rotate about a fixed axis to provide thrust in the ahead direction or the astern direction, depending on the direction of rotation of the propeller.

Figure 2A:
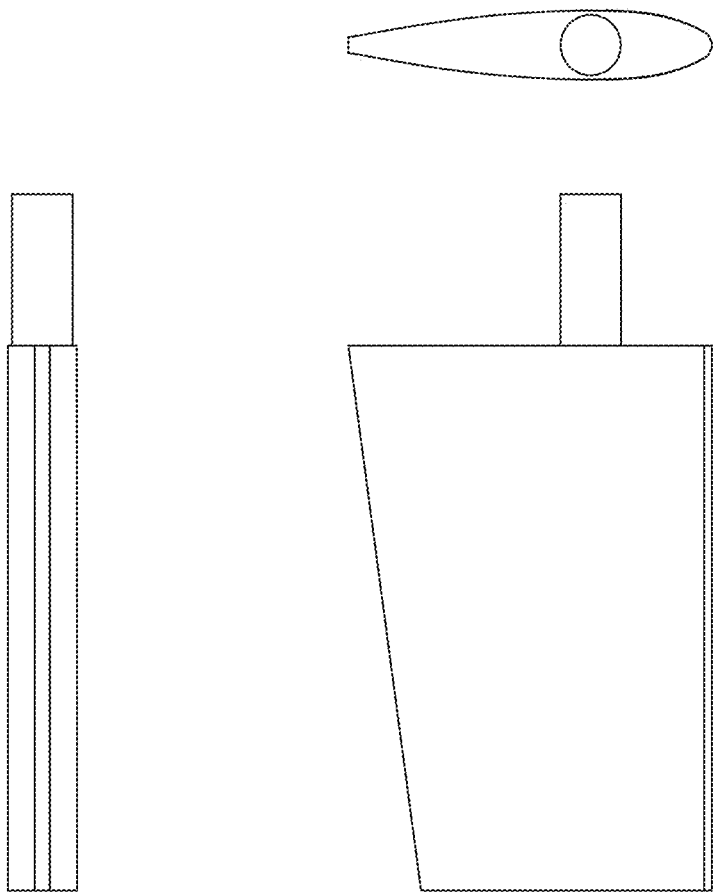
FIG. 2A shows an example of a rudder, including a front view (left), a top view (top) and a side view (bottom).
Figure 2B:
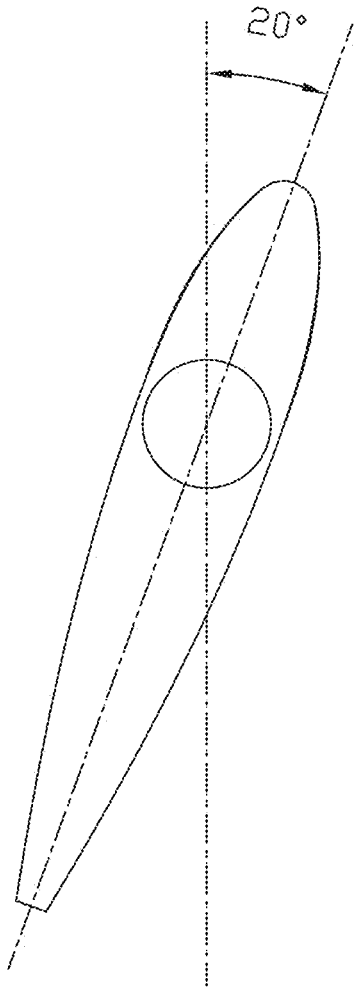
FIG. 2B shows the rudder of FIG. 2A deflected by 20 degrees.

A typical method for steering vessels with the above described propulsion systems is to place one or more controllable rudders (typically one rudder per propeller) behind (astern) of each propeller such that such that varying the rudder angle (or angle of attack with respect to the water flow exiting the propeller) will produce varying amounts of lift with a transverse component in order to steer the vessel. The rudder is positioned astern of a propeller such that it is within the stream of flow produced by the propeller when the propeller is producing forward thrust. A front, side and top view of one example of a rudder is shown in FIG. 2A. However, the apparatus and techniques described herein are not limited to use of a rudder as illustrated in FIG. 2A, as any suitable style or design of rudder may be used. FIG. 2B shows a top view of the rudder of FIG. 2A when the rudder is deflected 20 degrees with respect to a longitudinal datum (along a longitudinal axis of the marine vessel extending between the bow and the stern). However, it should be appreciated that a 20-degree deflection angle is an example, as a rudder may be deflected by any suitable angle.

Figure 3:
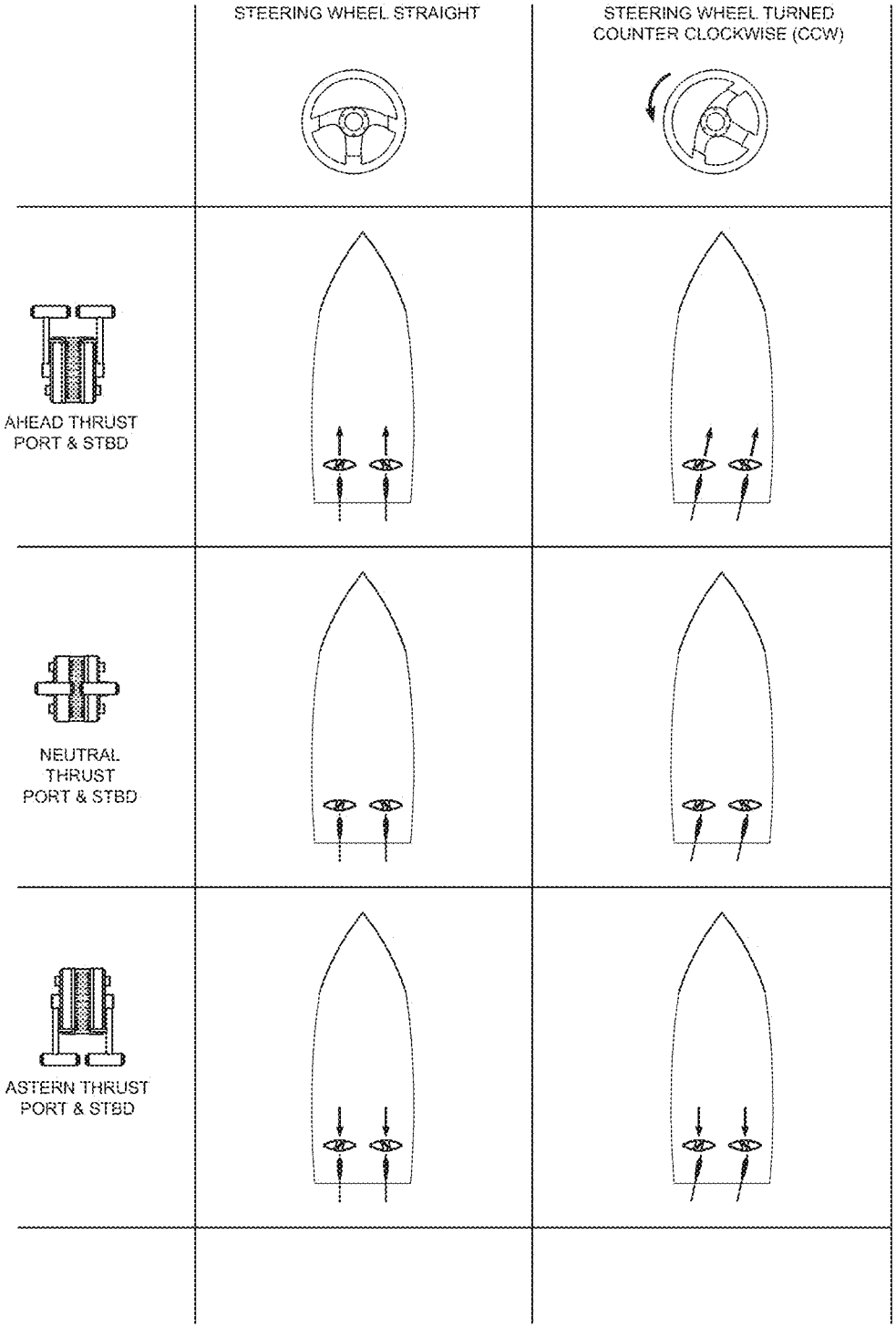
FIG. 3 shows a diagram illustrating steering with rudders only.

A known limitation with respect to the above-described propulsion and steering combination is the difficulty in producing sufficient steering or yawing forces at slow speeds. The aforementioned configuration can make holding the vessel heading at slow and zero speeds very difficult because there is little or no water flowing past the rudder at slow speeds. FIG. 3 illustrates an example of a technique for steering using the rudders only. The arrows in FIGS. 3-6 and 8 above the propellers illustrate the direction of force produced by the propellers. The left-most column of FIG. 3 shows three different positions for levers used for controlling the thrust produced by each engine. The lever on the left controls the thrust produced by the port engine. The lever on the right controls the thrust produced by the starboard engine. A lever in the forward position in FIG. 3 commands ahead thrust. A lever in the center position in FIG. 3 commands neutral thrust. A lever in the back position in FIG. 3 commands astern (reverse) thrust. The top-most row of FIG. 3 illustrates two different steering commands produced by a helm or tiller, which in FIG. 3 is illustrated as a steering wheel. The two different steering commands are for 1) a neutral steering position (left side of FIGS. 3), and 2) for the steering wheel turned counterclockwise (right side of FIG. 3). As illustrated in FIG. 3, when both thrust levers are in the forward position and the steering wheel is in the neutral (straight) position, both engines turn the propellers to produce an ahead thrust. The rudders are straight (approximately 0-degree deflection angle). As a result, the arrows show force vectors produced that are straight ahead. If the steering wheel is turned counterclockwise, the rudders are deflected at an angle such as that shown in FIG. 2B. As a result, the force vectors produced are at an angle that is ahead and to the starboard, which pushes the bow to the port. When the thrust levers are in a neutral position, no thrust is produced, and the rudders are moved in response to movement of the steering wheel. When the thrust levers are in the back position, both engines turn the propellers in the reverse direction and produce thrust astern. When the steering wheel is turned very little yawing force is produced because the rudders are now positioned out of the stream exiting the propellers due to the reverse rotation and associated direction of thrust. Accordingly, when the propellers produce thrust astern the resulting thrust produced will be substantially astern regardless of movement of the rudders.

Figure 4:
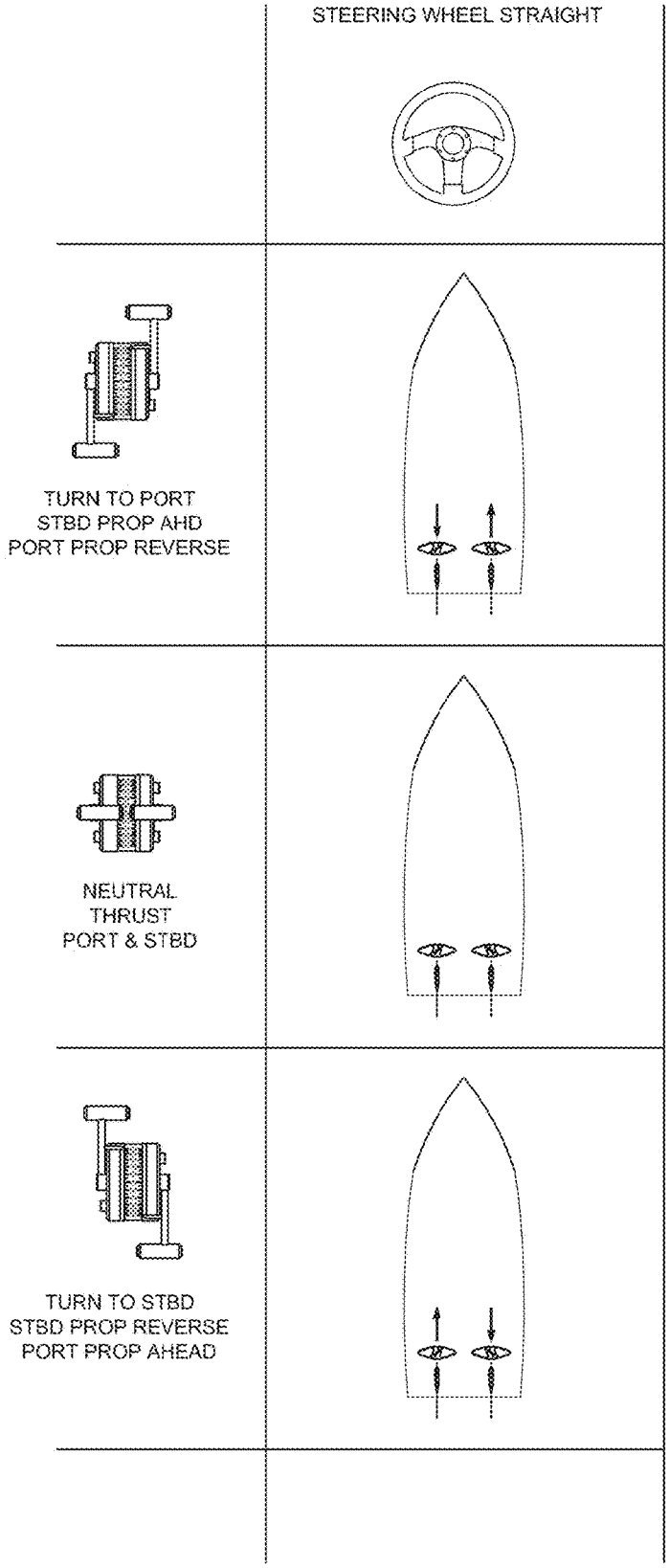
FIG. 4 shows a diagram illustrating steering with differential propulsor thrust only.

One way to develop yawing moments at slow or zero speed is to control the propeller RPM differentially. Depending on whether the vessel is stationary or moving forwards or backwards, the differential thrust necessary to apply the appropriate amount of yawing force may require the propellers to be engaged in opposite directions. For example, if the vessel is holding station and is required to develop a yawing force to move the bow in the port direction, the required yawing force could be developed by engaging the starboard propeller in the ahead direction and the port propeller in the reverse direction, while modulating the RPMs of the two propellers such that there is little or no net thrust forwards or backwards. In contrast, if the vessel is intended to be slowly moving backwards while moving the bow in the port direction, sufficient yawing force may be developed by keeping both engines clutched in reverse with the port RPM higher than the starboard RPM. FIG. 4 illustrates a technique for producing yawing forces to port or starboard by moving the thrust levers to produce forces in opposite directions by the port and starboard engines.

While it is possible to produce a yawing moment by differentially controlling the propeller RPM and direction of rotation of the propellers, the rudders are largely ineffective at slow speeds approaching zero, particularly when one of the propellers is engaged in the reverse direction in which case the water velocity around the rudder is low and the rudder's effect is more likely to be detrimental due to the likelihood that it will impede the flow of water into the reversing propeller.

It should also be noted that the ability to effectively produce a yawing moment by differentially controlling propeller thrust is directly related to the transverse distance between the propellers. The further apart the propellers are, the more yawing moment will be developed for the same differential thrust.

An additional challenge with the selective application of the above described method of steering a vessel with differential propeller RPM and rudders is the level of skill and training that is required for the coxswain to control the rudders and propellers simultaneously. Even with the engine RPM and gear integrated into a single lever for each propeller, the coxswain may find it challenging to control two levers and the helm with two hands.

A significant improvement can be established for controlling vessels with conventional propellers and rudders by integrating the differential thrust control with the steering control (using a wheel/helm or a tiller control device). In some embodiments, a control system may receive a steering command and/or a thrust command. The steering command indicates the desired direction and magnitude of yawing force applied to the vessel. The thrust command indicates the desired direction and magnitude of thrust to be imparted to the vessel. The control system may process the steering command and/or the thrust command and select control commands to control the direction and magnitude of thrust to be produced by each propulsion system and/or the angle of each rudder, and controls the propulsion systems and/or rudders accordingly. In some embodiments a human operator such as a coxswain does not need to provide independent control inputs for each propulsion system, which makes the vessel easier to operate. For example, the two thrust levers illustrated in FIGS. 3 and 4 may be replaced by a single lever, joystick or other input device to control thrust for the vessel as a whole rather than require individual controls for each engine.

In some embodiments, the control system described herein determines the state of thrust or movement of the vessel and controls the propulsion systems and/or rudders in combination to effectuate the desired movement. For example, if the control system determines (e.g., from the thrust command or another input such as a measurement of vessel speed) that the vessel is moving ahead fast enough for effective yaw control by the rudders alone, the control system may control the yaw of the vessel using the rudders alone. For example, the control system may map the steering command from the helm into a corresponding rudder position. In some embodiments, steering commands of increased magnitude (e.g., increasing turning of the wheel or deflection of the tiller with respect to a neutral position) are mapped to increasing deflection angles of one or more rudders. The mapping may be stored in a memory of the control system. If the control system determines that the vessel is moving at a slow speed, a neutral speed, or in reverse, such that effective yaw control may require differential thrust from the propellers, the control system may automatically control the propulsion systems and rudders in combination to produce a suitable yaw force. In some embodiments, steering commands of increased magnitude are mapped to increasing differential thrust produced by the propulsion systems. The mapping may be stored in a memory of the control system.

In some embodiments, the rudders may be decoupled from one another and controlled independently. Independent control of the rudders allows different rudder positions for the port and starboard propulsion systems, which may be particularly advantageous if one propulsion system is producing forward thrust and the other propulsion system is producing reverse thrust. For example, the rudder corresponding to the ahead thrusting propeller may be deflected while the rudder corresponding to the reverse thrusting propeller may be maintained at or close to the center position (little or no deflection). The thrust of the port and starboard propellers may be individually modulated (e.g., by varying engine revolutions per minute (RPM)) to maintain the desired net ahead or reverse thrust of the vessel. This technique is effective even at a net forward/reverse thrust of zero.

Figure 5:
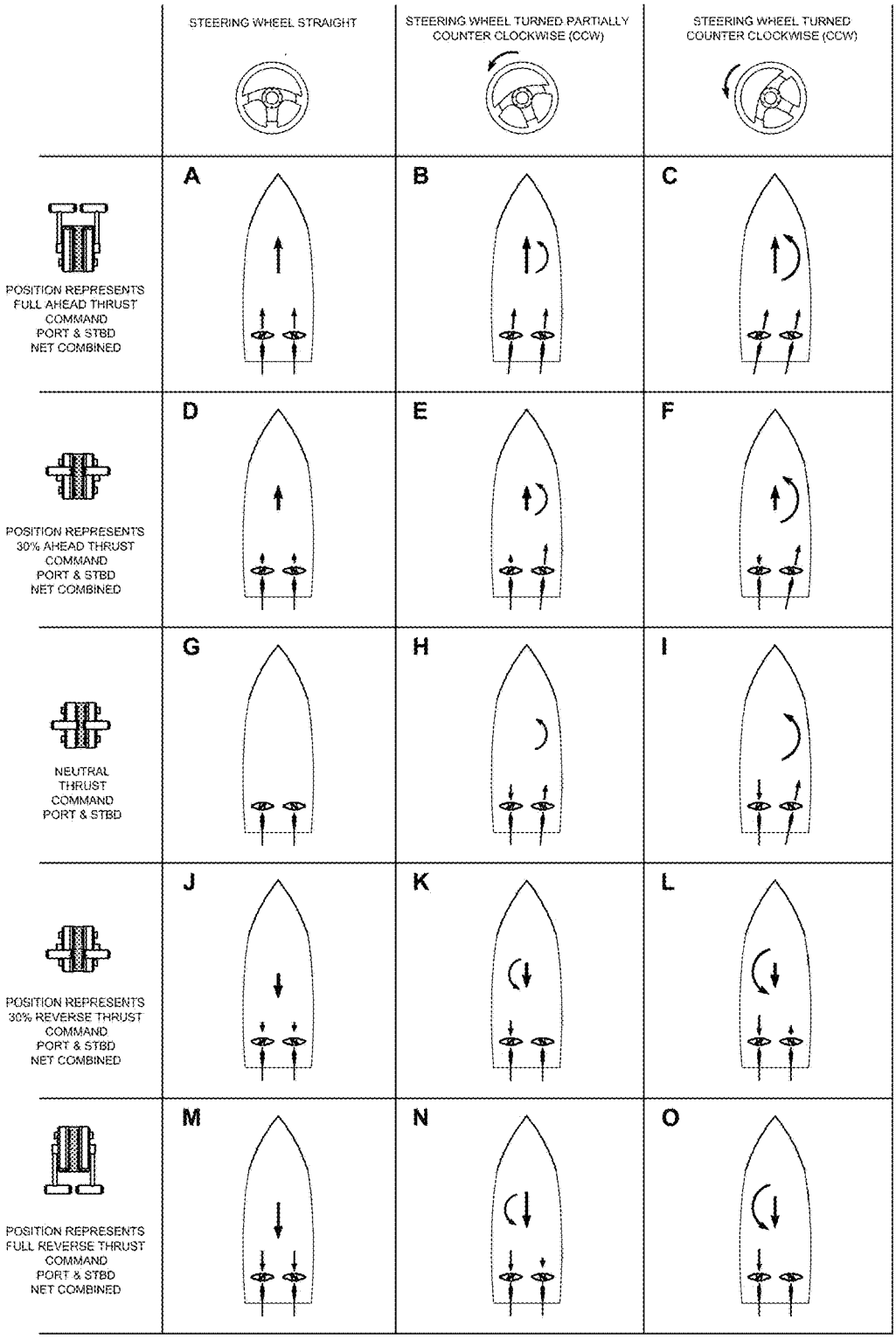
FIGS. 5 and 6 illustrate maneuvering in various modes with various combinations of rudder position and/or differential propulsor thrust, according to some embodiments.
Figure 6:
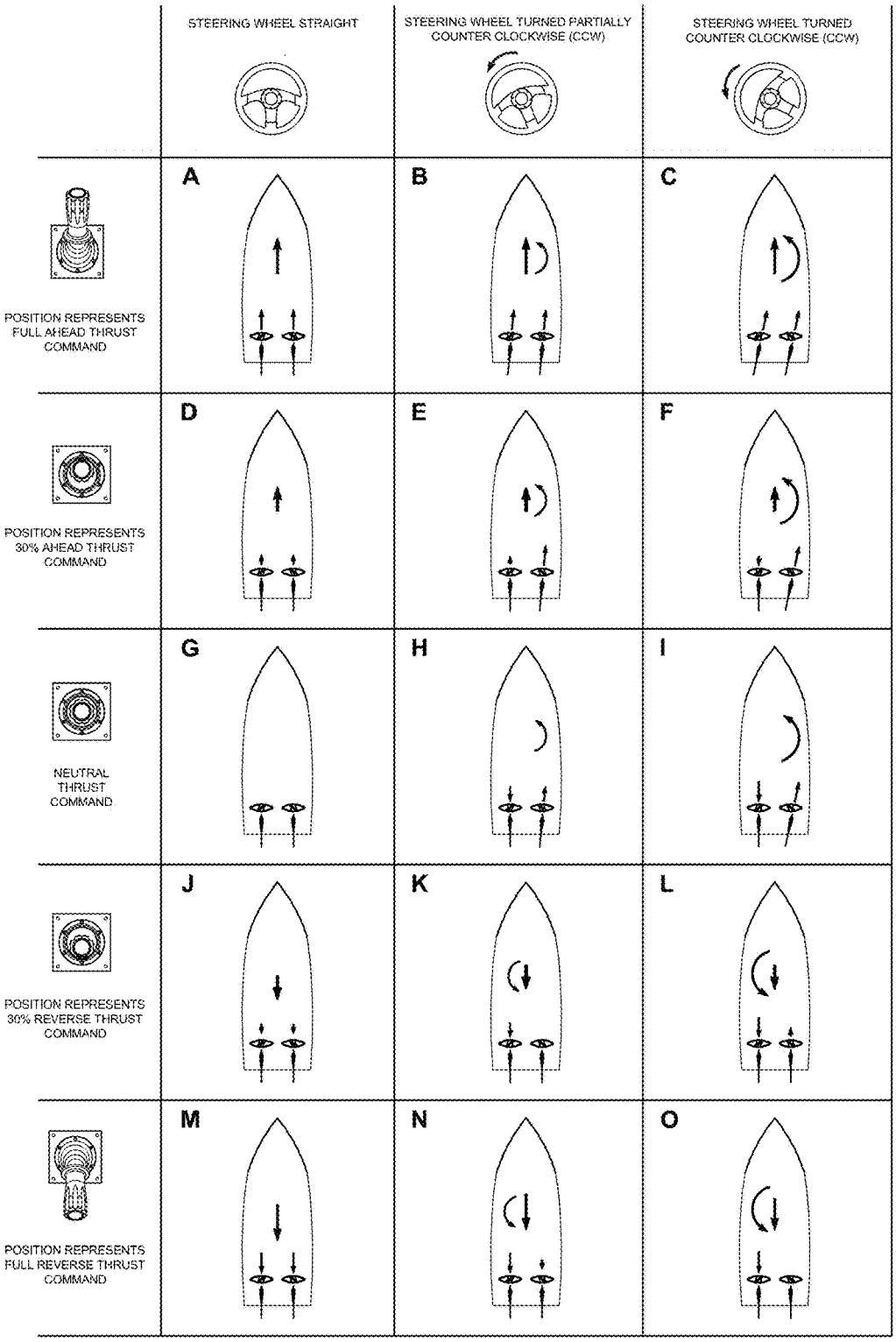

These techniques of controlling propeller thrust and direction with control of rudders can be implemented in systems where each propeller has one or more levers to control the RPM and direction of each propeller, as illustrated in FIG. 5 or in cases where the thrust produced by both propellers (RPM and direction) are controlled by a single stick such as a joystick, as illustrated in FIG. 6. FIGS. 5 and 6 illustrate the same maneuvers with only the input device changed (separate thrust levers for each propulsion system in FIG. 5 vs. single joystick for controlling thrust of the vessel in FIG. 6). To avoid repetition only FIG. 6 will be discussed in detail, with the understanding corresponding techniques may be implemented with the input devices illustrated in FIG. 5. The arrows shown in FIGS. 5, 6 and 8 in the center of the marine vessel show the net thrust and yawing force produced. The arrows above each propulsion system show the thrust produced by the combination of each propulsion system and its corresponding rudder.

In the example of FIG. 5, the two levers may be maintained at the same position, commanding a single overall thrust for the marine vessel, in which case the control system may detect the two levers are maintained in the same position, and control the vessel in accordance with the techniques discussed below and illustrated in FIG. 6. This configuration also provides the flexibility for the operator to manually control the thrust provided by each propulsion system. For example, moving one or both of the levers so they are no longer at the same position may disengage the automatic control illustrated in FIG. 6. This configuration allows the operator to manually control each engine individually in order to use the engines to apply a yawing force, with or without additional adjustments from the control system. Alternatively or additionally, when the levers are at different positions the control system may additionally apply differential thrust in response to a steering command to effect the desired yaw movement, as discussed below in connection with FIG. 6. For example, if an operator commands different thrust to be applied by the propulsion systems, a non-zero steering command may cause the control system to add a differential thrust in addition to that commanded by the operator using the levers, and control the propulsion systems based on the composite of the two commands.

FIG. 6 illustrates a joystick providing the same thrust commands as illustrated in FIG. 5. In this configuration, the control system automatically determines the amount of differential thrust to apply from the engines.

FIG. 6 shows how the control system can control the propulsion systems and rudders in combination in response to a steering command for the marine vessel (e.g., from a helm, such as a steering wheel, or tiller) and a thrust command for the marine vessel (e.g., from a joystick or lever(s)). The control system may determine the state of thrust or movement of the vessel (e.g., whether the vessel is moving ahead at a speed where yaw control only by the rudders is effective). The state of thrust or movement of the vessel may be determined based on the thrust command and/or based on another indication of forward/reverse movement of the marine vessel relative to the water, such as a signal from a sensor. Based on the determined state of thrust or movement of the marine vessel, the control system determines a suitable steering mode. Examples of steering modes include mode I: steering with one or more rudders and no differential thrust produced by the propellers, mode II: steering with both one or more rudders and differential thrust produced by the propellers, and mode III: steering with differential thrust produced by the propellers and not steering using the rudders. Based on the determined steering mode, suitable engine speeds and thrust directions as well as rudder positions are determined based on the thrust command and the steering command.

Maneuvers A, B and C in FIG. 6 show examples of configurations of the propulsion systems and rudders where the thrust command commands full thrust ahead, for three different steering commands. In this example, the control system determines a full ahead thrust command to be a state of the vessel where yaw control by the rudders is sufficiently effective and differential control of the propeller speed is not required. Accordingly, based on this determination, the control system operates in mode I. In maneuver A, the steering command is neutral (straight) and the rudders are maintained at substantially zero deflection angle. Maneuvers B and C illustrate configurations produced in response to steering commands of lesser (maneuver B) and greater (maneuver C) magnitude, corresponding to different positions of the steering wheel. In maneuvers B and C, when the steering wheel is turned the control system receives the steering command and maps the steering command into a suitable rudder deflection angle, and controls one or both rudders accordingly. In this state, variation of the steering command may only effect control of one or both rudders and not affect control of the propulsion systems, which are both producing full ahead thrust. A similar control technique may be used for lesser ahead thrust commands until the control system determines that yaw control should be performed at least partially by the propulsion systems (mode II).

Maneuvers D, E and F in FIG. 6 illustrate configurations of the propulsion systems and rudders when the thrust command is ahead at a relatively slow speed. In this example, the control system determines a 30% ahead thrust command to be a state of the vessel where yaw control should be performed at least partially by the propulsion systems and at least partially by at least one rudder. Based on this determination, the control system operates in mode II. In maneuver D, the steering command is neutral, so both rudders are maintained at substantially zero deflection angle, and both propulsion systems produce the same thrust, so the vessel has an ahead thrust with substantially no yaw induced. In maneuver E, when the steering wheel is turned the control system receives the steering command and maps the steering command and thrust command into suitable thrust directions and magnitudes for the propulsion systems as well as suitable rudder deflection angles. In this example, the steering command is to port, so the port propulsion system is controlled to produce less ahead thrust than the starboard propulsion system, and both propulsion systems are producing forward thrust. Since the port propulsion system is producing a small amount of thrust in this example, the port rudder may be controlled to be at a deflection angle of substantially zero since the port rudder may not have much impact on yaw moment due to the small amount of thrust produced by the port propulsion system. However, in some embodiments the port rudder may be deflected in such a configuration. The starboard propulsion system is controlled to produce forward thrust. The starboard rudder may be controlled to be at a suitable deflection angle to produce a yaw moment to port. Accordingly, each of the propulsion systems and rudders is controlled based on the thrust command and steering command. In maneuver F, the steering command is of a larger magnitude and in the same direction as for maneuver E. To produce the larger yaw moment commanded in configuration F, the differential thrust produced by the propulsion systems may be increased. For example, the port propulsion system may be controlled to produce reverse thrust and the starboard propulsion system may be controlled to produce an increased amount of forward thrust, as shown. The deflection of the starboard rudder may be increased in maneuver F with respect to that shown for maneuver E. The port rudder may be controlled to be at a deflection angle of approximately zero since the port propulsion system is producing reverse thrust. It should be appreciated that a 30% ahead thrust command is an example, and other thrust commands may correspond to a point at which the control system switches between operation in mode I and mode II or may not require the port ahead thrust to be reduced to the point where the thrust direction is reversed.

Maneuvers G, H and I illustrate configurations of the propulsion systems and rudders when the thrust command is neutral (zero). In this example, the control system determines a zero thrust command to be a state of the vessel where yaw control should be performed at least partially by the propulsion systems and at least partially by at least one rudder. Based on this determination, the control system operates in mode II. In maneuver G, both the thrust command and steering command are zero, so the propulsion systems do not produce any thrust and the rudders have zero or approximately zero deflection. In maneuver H, in response to a steering command to port the control system determines a neutral thrust command to be a state of the vessel where yaw control should be performed at least partially by the propulsion systems. Control is then performed similarly to configuration F, but with a larger reverse thrust produced in the port engine to cancel out the forward thrust from the starboard engine. Since the port propulsion system is producing reverse thrust, the port rudder may be controlled to be at a deflection angle of at or around zero to allow flow of water into the port propulsion system. The starboard propulsion system is controlled to produce forward thrust. The starboard rudder may be controlled to be at a suitable deflection angle to produce a yaw moment. Accordingly, each of the propulsion systems and rudders is controlled based on the thrust command and steering command. Maneuver I is similar to maneuver H but with larger differential thrusts produced by the propulsion systems and larger deflection angle of the starboard rudder. Although less effective for the same RPM levels, maneuvers H and I could be alternatively implemented with differential thrust only (mode III), with both rudders at a deflection angle of at or around zero.

Maneuvers J, K and L illustrate configurations of the propulsion systems and rudders when the thrust command is reverse 30% with or without information from additional sensors or the propulsion system. In this example, the control system determines a 30% reverse thrust command to be a state of the vessel where yaw control should be performed at least partially by the propulsion systems without the use of the rudders. Based on this determination, the control system operates in mode III. More specifically, in this example the rudders are not used for yaw control because neither propulsion system produces an ahead thrust. In maneuver J, both propulsion systems produce the same reverse thrust and no yaw moment is produced. In maneuver K the port propulsion system is controlled to produce a reverse thrust. The starboard propulsion system is controlled to produce no or minimal thrust. The differential thrust produced by the propulsion systems produces a yaw moment to port. The rudders may be set to a deflection angle at or around zero to allow water to flow into the propulsion systems. Accordingly, each of the propulsion systems and rudders is controlled based on the thrust command and steering command. Maneuver L is similar to maneuver K but with larger differential thrust, which in this example is produced by increased reverse thrust produced by the port propulsion system and a small amount of forward thrust produced by the starboard propulsion system. It should be appreciated that a 30% reverse thrust command is an example, and other thrust commands may correspond to a point at which the control system switches between operation in mode II and mode III.

Maneuvers M, N and O illustrate similar control as in maneuvers J, K and L, respectively, but for a thrust command of full reverse. Based on the thrust command of full reverse, the control system operates in mode III. Maneuver M is similar to maneuver J, but with increased reverse thrust produced by both propulsion systems. Maneuver N is similar to maneuver K, but with larger reverse thrust produced by the port propulsion system and a small amount of reverse thrust produced by the starboard propulsion system. Maneuver O is similar to maneuver L but with larger reverse thrust produced by the port propulsion system and less ahead thrust (such as no thrust or a small amount of reverse thrust) produced by the starboard propulsion system The rudders may be set to a deflection angle of at or around zero. Accordingly, each of the propulsion systems and rudders is controlled based on the thrust command and steering command.

It should be appreciated that a steering command to port is illustrated for simplicity, and that control when the steering command is to starboard is essentially a mirror image of the control shown for steering commands to port.

Figure 8:
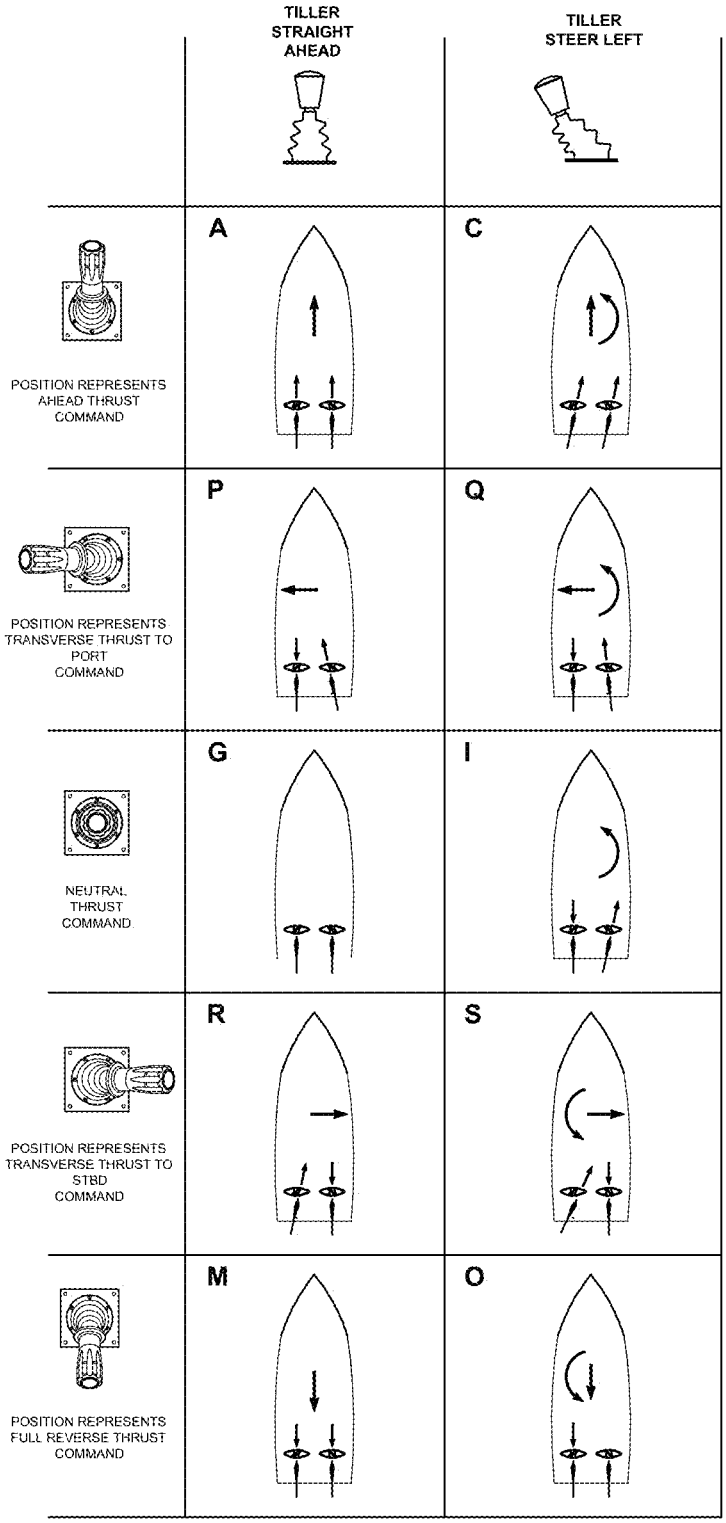
FIG. 8 illustrates various maneuvers including maneuvers that impart a translational thrust on the marine vessel.

In some embodiments, the techniques of FIG. 6 may be used in combination with transverse thrust commands and corresponding control techniques as shown in FIG. 8. FIG. 8 shows a tiller providing the steering command instead of a steering wheel. However, as mentioned above, any suitable device may be used to provide the steering command, and it should be appreciate that the illustration of a steering wheel in FIGS. 5 and 6 and a tiller in FIG. 8 is merely to illustrate different examples of an apparatus providing the steering command signal. FIG. 8 shows a number of the same maneuvers (A, C, G, I, M and O) illustrated in FIGS. 5 and 6. FIG. 8 additionally shows maneuvers in response to a transverse translational thrust command to port or starboard. In maneuver P, a translational thrust command to port and a neutral steering command are received. To produce translational thrust to port, the port propulsion system is operated with reverse thrust and the starboard propulsion system is operated with an amount of forward thrust selected to cancel the reverse thrust produced by the port propulsion system. The port rudder may be maintained at a deflection angle of at or near zero. The starboard rudder is deflected to port to produce a translational force to port. Maneuver Q is similar to maneuver P but with less deflection of the starboard rudder to additionally produce a yaw moment to turn the vessel to port. Maneuver R is essentially a mirror image of maneuver P, to effect translation to the starboard instead of port. Maneuver S is similar to maneuver R, but with additional deflection of the port rudder to starboard to produce a yawing moment of the vessel to port while producing a translational force to starboard.

Maneuvers in response to translational movement commands other than those shown in FIG. 8 can also be implemented using the concepts illustrated in FIG. 8. For example, diagonal movements of the joystick illustrated in FIG. 8 command translational movement of the vessel that has both a forward-reverse component and a transverse (port or starboard) component. Such diagonal translational movement commands can be implemented by overlaying an ahead or reverse component onto the configurations shown for maneuvers P, Q, R and S by moving the joystick forward or backwards. For example, if the translational thrust command to port is modified to include an ahead component or a reverse component, the same configurations as shown for maneuvers P and Q may be used, but with a corresponding ahead or reverse thrust component added to both propulsion systems by moving the joystick forward or reverse to a diagonal position (e.g., if an ahead thrust component is commanded by the joystick, an ahead thrust component may be added to both the port and starboard propulsion systems). Similarly, if a translational thrust command to starboard is modified to include an ahead component or a reverse component, the same configurations as shown for maneuvers R and S may be used, but with a corresponding ahead or reverse thrust component added to both propulsion systems by moving the joystick to the respective diagonal positions. The system could be enhanced by implementing a means to slip the clutches such as the application of a trolling valve in order to reduce the propeller RPM below the fully engaged idle RPM. Alternatively or additionally, the control system could be enhanced by connecting to the engine sensors (either via a data bus or directly to sensors) in order to sense parameters such as RPM, torque, or turbo boost and/or estimate parameters such as thrust for improved response and/or accuracy, as well as more effectively determine the proper operating mode. Alternatively or additionally, the system could be enhanced by integrated outside sensors such as GPS or other sensors for position and/or speed and/or accelerometers in order to estimate or calculate the vessel state or conditions. In some embodiments, the state of motion of the vessel as measured by sensors is used to determine the control zone, instead of or in addition to use of the thrust command to determine the control zone, as described above. For example, the control system may use the magnitude and direction of forward/reverse motion of the marine vessel to determine whether to operate in mode I, mode II or mode III. Suitable thresholds may be established for motion and/or thrust commands for determining when to transition from one mode to another. Similarly, information obtained from the propulsion system such as torque, turbo boost, and RPM may be used to determine the operating mode, propeller speed (RPM) command, and rudder commands.

Figure 7:
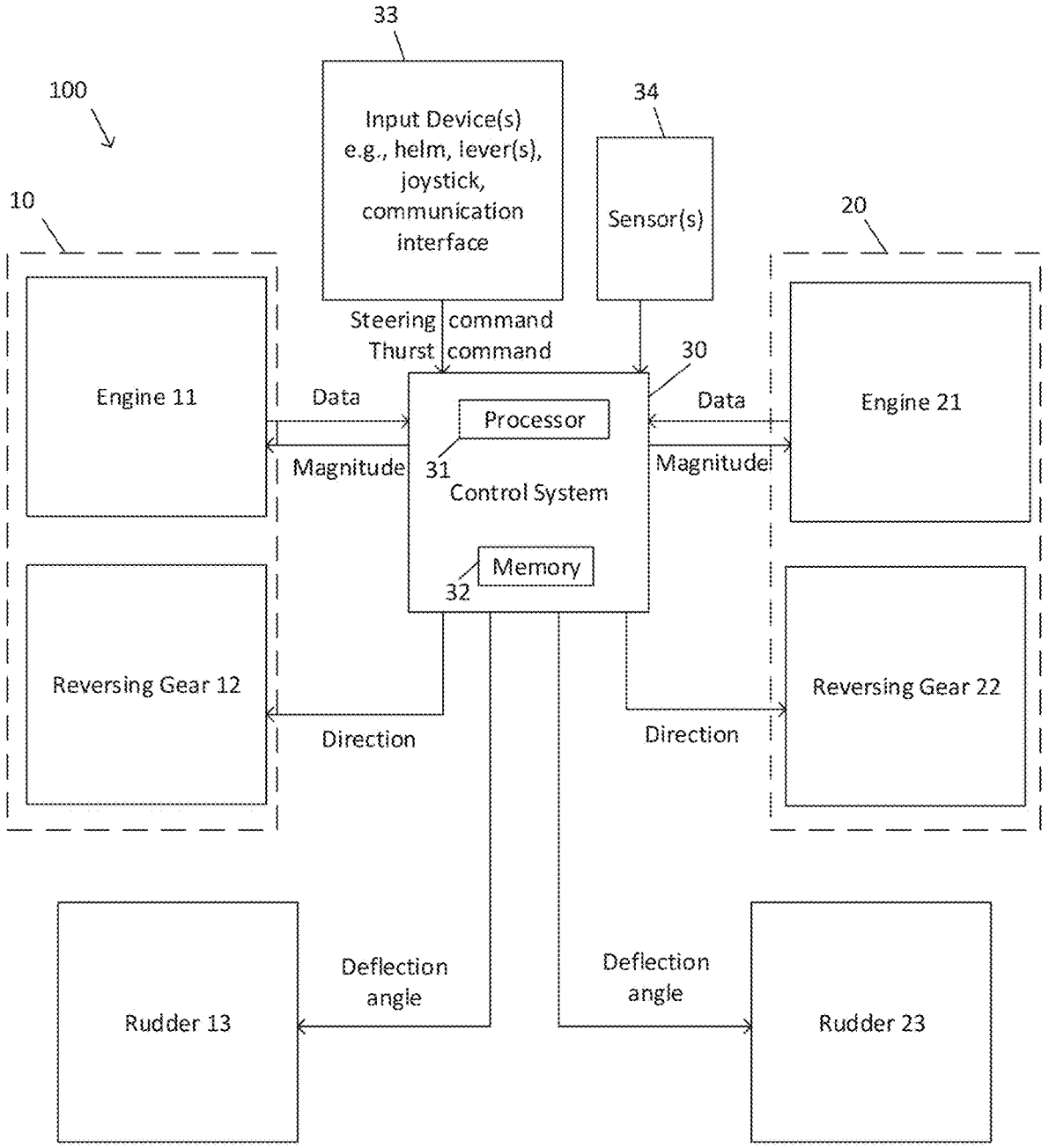
FIG. 7 shows a block diagram of a marine vessel propulsion and control system, according to some embodiments.

FIG. 7 shows a block diagram of a marine vessel propulsion, steering, and control system 100. The system of FIG. 7 includes propulsion system 10 including engine 11 and reversing gear 12. Also included is a corresponding rudder 13. Propulsion system 20 includes an engine 21 and reversing gear 22. Also included is a corresponding rudder 23. The control system 30 includes at least a processor 31 and a memory 32. The processor 31 may run suitable software to implement the above-described control techniques. The memory 32 may store mappings from received control commands (e.g., steering commands and thrust commands) to control commands for the propulsion systems and rudders, as discussed above. Control system 30 receives one or more thrust commands and/or a steering command from one or more input devices 33. Once appropriate commands for the propulsion systems and/or rudders are identified based on the received information, the control system sends signals to control the propulsion systems and rudders accordingly. The control system may receive the steering and thrust commands or other information from a variety of suitable devices. For example, as discussed above, steering commands may be input by a person through a helm, such as a steering wheel, or tiller. Thrust commands may be input by a person through lever(s) or a joystick, for example. Each is an example of an input device 33. However, any suitable input devices 33 may provide the commands. There may be one control station for the marine vessel with suitable input devices 33 or more than one control station in different locations of the marine vessel. In some embodiments, the input device 33 is a communication device that may receive commands remotely (e.g., through radio communication) from a remote computing device or an autopilot or dynamic positioning system. In some embodiments, one or more sensors 34 may provide information to the control system 30 such as the forward or reverse movement of the marine vessel, as discussed above. In some embodiments, the system may receive high level commands such as course and speed and the control system will determine the proper thrust and yaw commands in response to the high level commands, which will in-turn lead to corresponding commands to the engines, gears, and rudders.

The engines (11, 21), reversing gears (12, 22), and rudders (13, 23) can be controlled many different ways. Some embodiments are highly integrated and incorporate all or most of the elements needed to position the rudders (13, 23), control the engines (11, 21) RPM and control the reversing gears (12, 22) state (Ahead, Reverse, and amount of clutch slip {if a slipping clutch is used}). For example, positioning the rudder may be performed using a direct interface to a hydraulic control valve, such as a proportional valve, to modulate the flow of hydraulic oil to and from a steering actuator (sometimes referred to as a steering ram). Some embodiments incorporate steering position feedback signals from a rudder position sensor in what is known in the art as a full-follow-up or feedback control system. Other embodiments may send an electronic control signal such as an analog or digital (e.g., serial) signal to a separate steering control system that incorporates all electronics and hydraulics necessary to position the rudders (13, 23) in response to the electronic signal. It is to be understood that there are many ways to control a rudder and all methods are within the scope of this invention. The Deflection angle signals shown in FIG. 7 are intended to represent all types and methods for positioning a rudder.

There are many types of engine (11, 21) interfaces, that include but are not limited to analog, variable frequency, pulse width modulated (PWM) and serial (CAN, NMEA2000, etc.). The Magnitude signal shown in FIG. 7 is intended to represent any type of engine interface, including those corresponding to commanded engine RPM. The Data signal in FIG. 7 can provide engine data back to the control system such as torque and boost pressure via a digital (e.g., serial) data stream (such as CAN or MODBUS) or via discrete analog or digital inputs.

Similar to controlling the rudders (13, 23), the interface to the Reversing Gear (12, 22) can be a direct connection to the hydraulic valves that control the Ahead, Reverse, or slipping functions, or an electronic connection to a separate system that is responsible for directly actuating the gear shifting mechanism(s). The Direction signal shown in FIG. 7 is intended to represent all methods for controlling a reversing gear.

Figure 9:
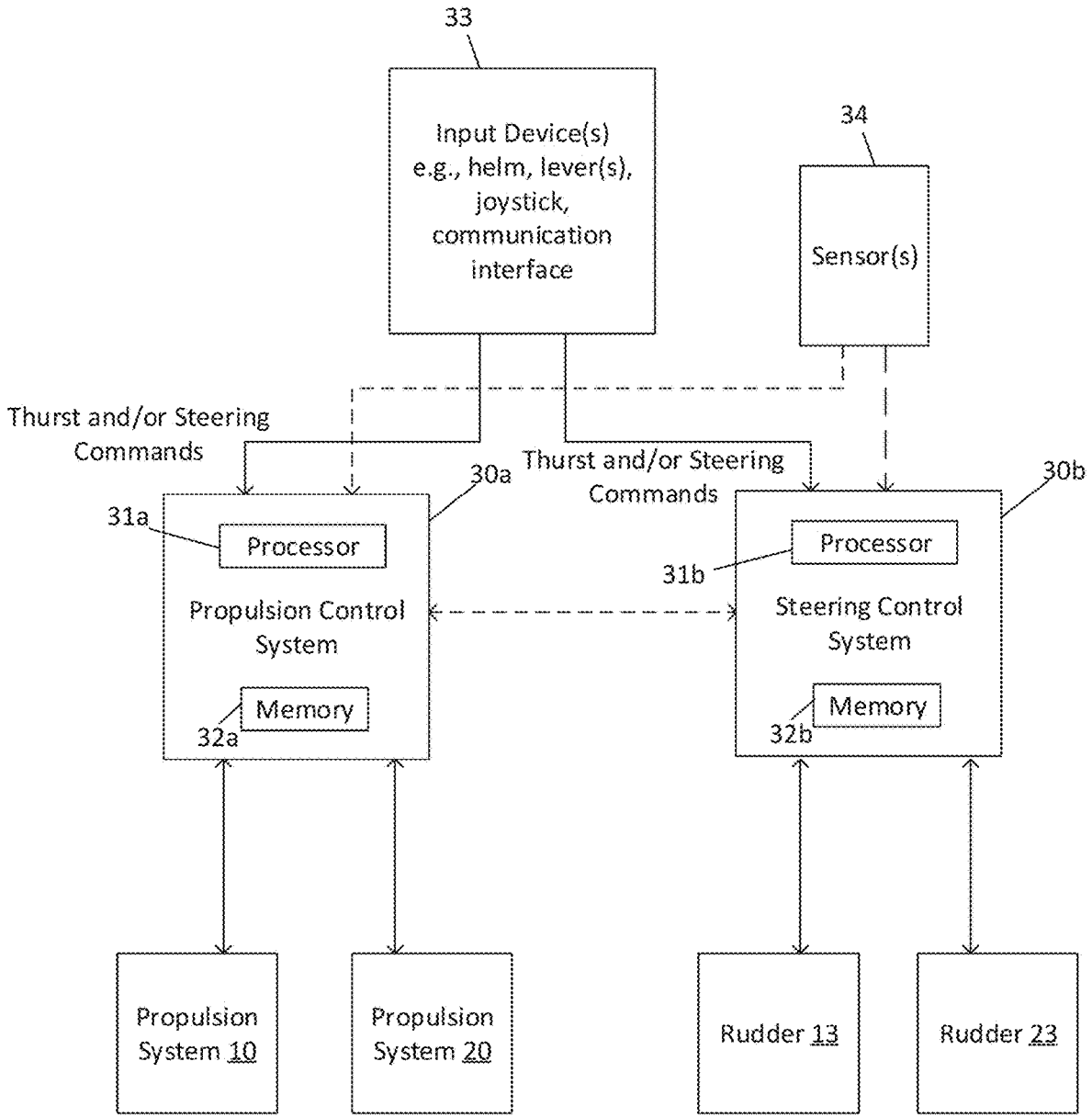
FIG. 9 shows a block diagram of a system with separate propulsion and steering control systems.

FIG. 9 shows a block diagram illustrating a separate propulsion control system and steering control system. The propulsion control system 30*a* may control the propulsion systems 10 and 20 and may not control the rudders 13 and 23. Similarly, the steering control system may control the rudders 13 and 23 and may not control the propulsion systems 10 and 20. A system with separate propulsion and steering control systems may implement any of the maneuvers and configurations described herein. In particular, the propulsion control system 30*a* may be configured to receive a steering command and/or thrust command 33 and/or signals from sensor(s) 34, and may control the propulsion systems to produce a desired thrust on the marine vessel and/or a differential thrust to impart a yaw moment. Propulsion control system 30*a* may include a processor 31*a* and memory 32*a* and may produce control signals to control the propulsion systems 10 and 20 as discussed above. Steering control system 30*b* may be configured to receive a steering command and/or a thrust command 33 and/or signals from sensor(s) 34, and may control the rudders 13 and 23 in accordance with the techniques described herein. For example, at a sufficient thrust the steering command may be mapped into suitable deflection angles for the rudders. When the thrust for a propulsion system is zero or in reverse, the corresponding rudder may be set to a deflection angle of zero or approximately zero. Steering control system 30*b* may include a processor 31*b* and memory 32*b* and may produce control signals to control the rudders 13 and 23 as described above. In some embodiments, the propulsion control system 30*a* and steering control system 30*b* may be in communication with one another to exchange information that may be used by the other system. For example, if propulsion control system 30*a* receives a thrust command for the vessel as a whole (e.g., from a joystick), the control system 30*a* may map the thrust command into commands to the individual propulsion systems 10 and 20, including information such as magnitude and direction of the thrust to be produced. This information may be provided to the steering control system 30*b* for use in controlling the rudders. For example, steering control system 30*b* may set the deflection angle of a rudder to zero or approximately zero when the direction of thrust in the corresponding propulsion system is in reverse, or when the magnitude of the forward thrust is low. As another example, the steering control system 30*b* may receive a steering command and map the steering command into a differential thrust command for the propulsion control system 30*a*, and send such a command to the propulsion control system 30*a*. The propulsion control system 30*a* may add the commanded differential thrust onto one or more received thrust commands for the propulsion system, and control the propulsion systems using the sum of the two commands to produce a suitable differential thrust in addition to any commanded forward/reverse thrust.

The above-described embodiments can be implemented in any of numerous ways. For example, the embodiments may be implemented using hardware, software or a combination thereof. When implemented in software, the software code can be executed on any suitable processor (e.g., a microprocessor) or collection of processors, whether provided in a single computing device or distributed among multiple computing devices. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation of the embodiments described herein comprises at least one computer-readable storage medium (e.g., RAM, ROM, EEPROM, flash memory or other memory technology, CD-ROM, digital versatile disks (DVD) or other optical disk storage, magnetic cassettes, magnetic tape, magnetic disk storage or other magnetic storage devices, or other tangible, non-transitory computer-readable storage medium) encoded with a computer program (i.e., a plurality of executable instructions) that, when executed on one or more processors, performs the above-discussed functions of one or more embodiments. The computer-readable medium may be transportable such that the program stored thereon can be loaded onto any computing device to implement aspects of the techniques discussed herein. In addition, it should be appreciated that the reference to a computer program which, when executed, performs any of the above-discussed functions, is not limited to an application program running on a host computer. Rather, the terms computer program and software are used herein in a generic sense to reference any type of computer code (e.g., application software, firmware, microcode, or any other form of computer instruction) that can be employed to program one or more processors to implement aspects of the techniques discussed herein.

Having described various embodiments of a marine vessel control system and method herein, it is to be appreciated that the concepts presented herein may be extended to systems having any number or type of actuators and propulsion devices and is not limited to the embodiments presented herein. Modifications and changes will occur to those skilled in the art and are meant to be encompassed by the scope of the present description.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including", "comprising", "having", "containing" or "involving" and variations thereof herein, is meant to encompass the items listed thereafter and equivalents thereof as well as additional items.

The use of "coupled" or "connected" is meant to refer to circuit elements, or signals, that are either directly linked to one another or through intermediate components.

The terms "approximately", "substantially", "about" and "near" as used herein with respect to an angle means within plus or minus 5 degrees, preferably within plus or minus 3 degrees, inclusive. When such terms are used with respect to a thrust, they mean within plus or minus 10%, preferably within plus or minus 5%, inclusive, with respect to maximum thrust.

What is claimed is:

1. A control system for a marine vessel having a first propulsion system, a first rudder corresponding to the first propulsion system, a second propulsion system, and a second rudder corresponding to the second propulsion system, the control system comprising:

a processor configured to:

receive information indicating a state of forward or reverse movement of the marine vessel;

set a control mode based on the information indicating a state of forward or reverse movement of the marine vessel;

based on the control mode, map a thrust command for the marine vessel and a steering command for the marine vessel into control commands for the first propulsion system, the first rudder, the second propulsion system and the second rudder; and control the first propulsion system, the first rudder, the second propulsion system and the second rudder using the control commands.

2. The control system of claim 1, wherein when the information indicates forward movement of the marine vessel above a threshold, the processor sets the control mode to steer the marine vessel using the first and second rudders and not to steer the marine vessel using the first and second propulsion systems.

3. The control system of claim 1, wherein when the information indicates forward movement of the marine vessel below a threshold or neutral forward/reverse movement of the marine vessel, the processor sets the control mode to steer the marine vessel using both the first and second propulsion systems and the first rudder.

4. The control system of claim 3, wherein the processor controls the first propulsion system to have a forward thrust, the second propulsion system to have a reverse thrust, and deflects the first rudder behind the first propulsion system to turn the marine vessel in a direction of the steering command.

5. The control system of claim 4, wherein the processor controls a second rudder behind the second propulsion system to have a deflection angle of approximately zero.

6. The control system of claim 1, wherein when the information indicates reverse movement of the marine vessel of a sufficient magnitude, the processor sets the control mode to steer the marine vessel using the first and second propulsion systems and not to steer the marine vessel using the first rudder or the second rudder.

7. The control system of claim 1, wherein the processor is configured to maintain the second rudder at or approximately at a deflection angle of zero when the second propulsion system is producing reverse thrust.

8. The control system of claim 1, wherein the processor is configured to steer the marine vessel using the second rudder when the second propulsion system is producing sufficient ahead thrust.

9. The control system of claim 7 or 8, wherein the processor is configured to control the first propulsion system and the second propulsion system to produce differential thrusts in response to a steering command.

* * * * *